US008132646B2

(12) United States Patent
Kiesewetter et al.

(10) Patent No.: US 8,132,646 B2
(45) Date of Patent: Mar. 13, 2012

(54) EXHAUST GAS MUFFLER

(75) Inventors: Fritz Kiesewetter, Stuttgart (DE); Georg Maier, Kernen i. R. (DE)

(73) Assignee: Andreas Stihl AG & Co. KG (DE)

( * ) Notice: Subject to any disclaimer, the term of this patent is extended or adjusted under 35 U.S.C. 154(b) by 155 days.

(21) Appl. No.: 12/555,660

(22) Filed: Sep. 8, 2009

(65) Prior Publication Data

US 2010/0011754 A1 Jan. 21, 2010

Related U.S. Application Data

(63) Continuation-in-part of application No. 10/913,029, filed on Aug. 5, 2004, now abandoned.

(30) Foreign Application Priority Data

Aug. 6, 2003 (DE) ..... 103 35 864

(51) Int. Cl.
*F01N 13/06* (2010.01)

(52) U.S. Cl. ..... 181/240; 181/231

(58) Field of Classification Search ..... 181/231, 181/240, 265
See application file for complete search history.

(56) References Cited

U.S. PATENT DOCUMENTS

| | | | | |
|---|---|---|---|---|
| 4,164,989 | A * | 8/1979 | Lux et al. | 181/265 |
| 4,846,301 | A * | 7/1989 | Granath et al. | 181/230 |
| 5,109,949 | A * | 5/1992 | Sato et al. | 181/240 |
| 5,440,083 | A * | 8/1995 | Masuda | 181/240 |
| 5,866,859 | A * | 2/1999 | Karlsson et al. | 181/230 |
| 5,877,461 | A | 3/1999 | Karlsson et al. | |
| 6,341,662 | B1 * | 1/2002 | Karlsson | 181/230 |
| 6,393,835 | B1 * | 5/2002 | Stoll et al. | 60/299 |
| 6,422,338 | B1 * | 7/2002 | Menzel et al. | 181/230 |
| 6,789,644 | B2 * | 9/2004 | Mukaida | 181/272 |
| 2003/0173148 | A1 * | 9/2003 | Andersson et al. | 181/272 |

FOREIGN PATENT DOCUMENTS

WO WO0236942 5/2002

* cited by examiner

*Primary Examiner* — Jeremy Luks
(74) *Attorney, Agent, or Firm* — Robert W. Becker; Robert Becker & Associates

(57) ABSTRACT

An exhaust gas muffler for an internal combustion engine, especially the engine of a manually-guided implement such as a power saw, a cut-off machine, or the like. The muffler has a housing having an inlet for exhaust gases and an outlet out of the housing. The housing has an outer wall over which the exhaust gases from the outlet flow. To achieve an adequate cooling of the exhaust gas muffler and the discharging exhaust gases, the exhaust gases out of the outlet draw in atmospheric air between the exhaust gases and the outer wall of the housing.

19 Claims, 6 Drawing Sheets

Fig. 3
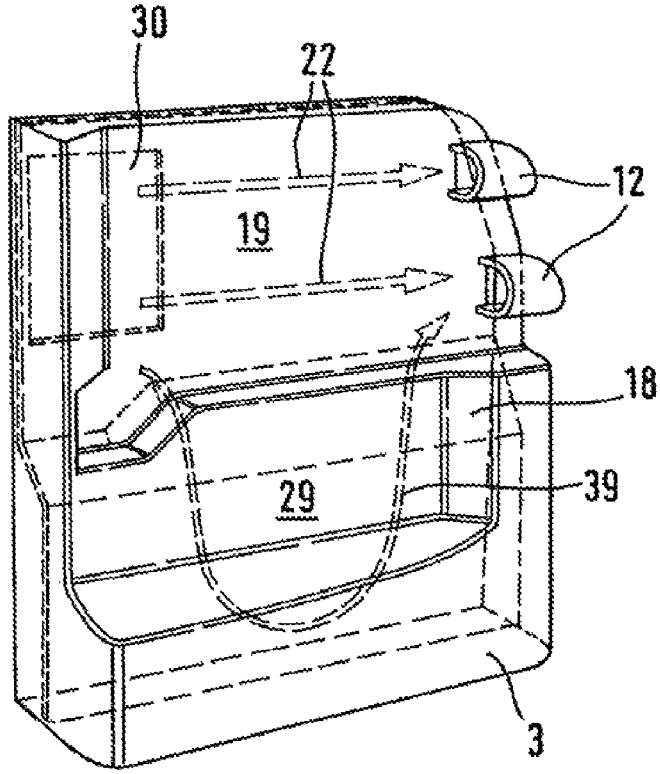
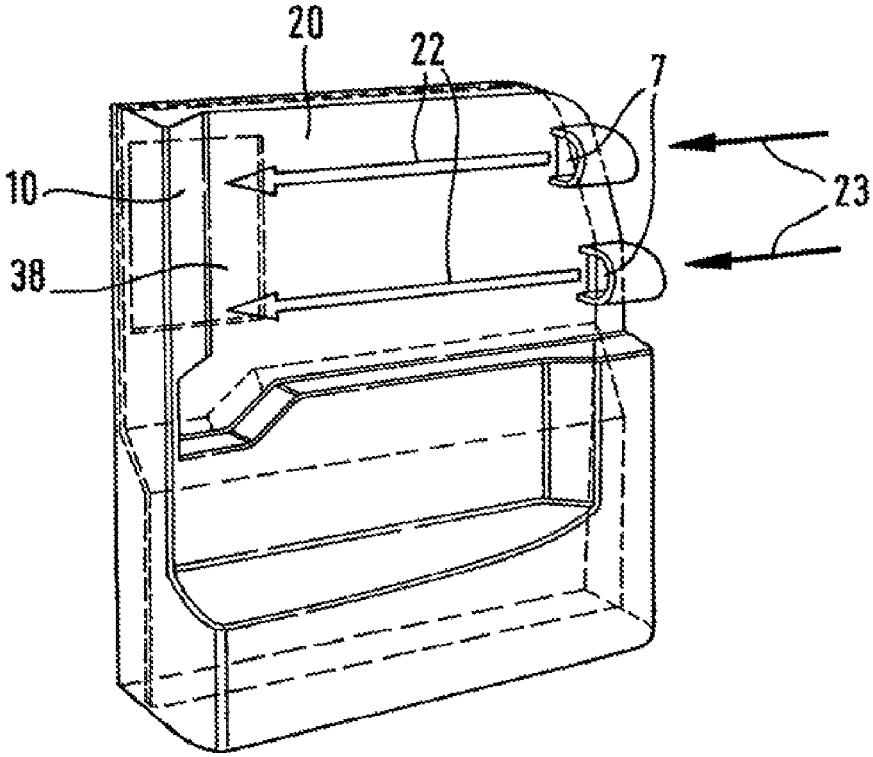
Fig. 4

EXHAUST GAS MUFFLER

CROSS-REFERENCE TO RELATED APPLICATIONS

This application is a continuation-in-part of application Ser. No. 10/913,029 filed Aug. 5, 2004 now abandoned.

BACKGROUND OF THE INVENTION

The present invention relates to an exhaust gas muffler for an internal combustion engine, especially a two-cycle engine in a manually-guided implement such as a power saw, a cut-off machine, or the like.

An exhaust gas muffler is known from DE 696 18 194 T2, according to which exhaust gases exiting from the outlet flow out over a housing wall of the muffler. This is intended to achieve a good mixing of the exhaust gases with the cooling air of the internal combustion engine that is conveyed by a fan, so that the exhaust gas temperature drops. Due to the mixing of the exhaust gases with the cooling air stream, however, it is possible to achieve only a slight drop in the temperature of the exhaust gas. Furthermore, with exhaust gas mufflers having a catalytic converter, the exhaust gas is greatly reheated in the catalytic converter. No adequate drop in the temperature of the exhaust gases can be achieved by mixing the exhaust gases with cooling air. At the same time, the exhaust gas muffler is greatly heated up by the high exhaust gas temperatures, so that additional thermal insulation must be provided for the exhaust gas muffler. Such thermal insulation measures are expensive, and increase the overall size of the exhaust gas muffler.

It is therefore an object of the present invention to provide an exhaust gas muffler of the aforementioned general type that has a straightforward construction and a small overall size, and with which low exhaust gas temperatures can be achieved.

BRIEF DESCRIPTION OF THE DRAWINGS

This object, and other objects and advantages of the present invention, will appear more clearly from the following specification in conjunction with the accompanying schematic drawings, in which:

FIG. 3 illustrates the flows between the second partition and the upper half of an exhaust gas muffler;

FIG. 4 illustrates the flows along the outer wall of the housing of an exhaust gas muffler;

SUMMARY OF THE INVENTION

Figure 1:
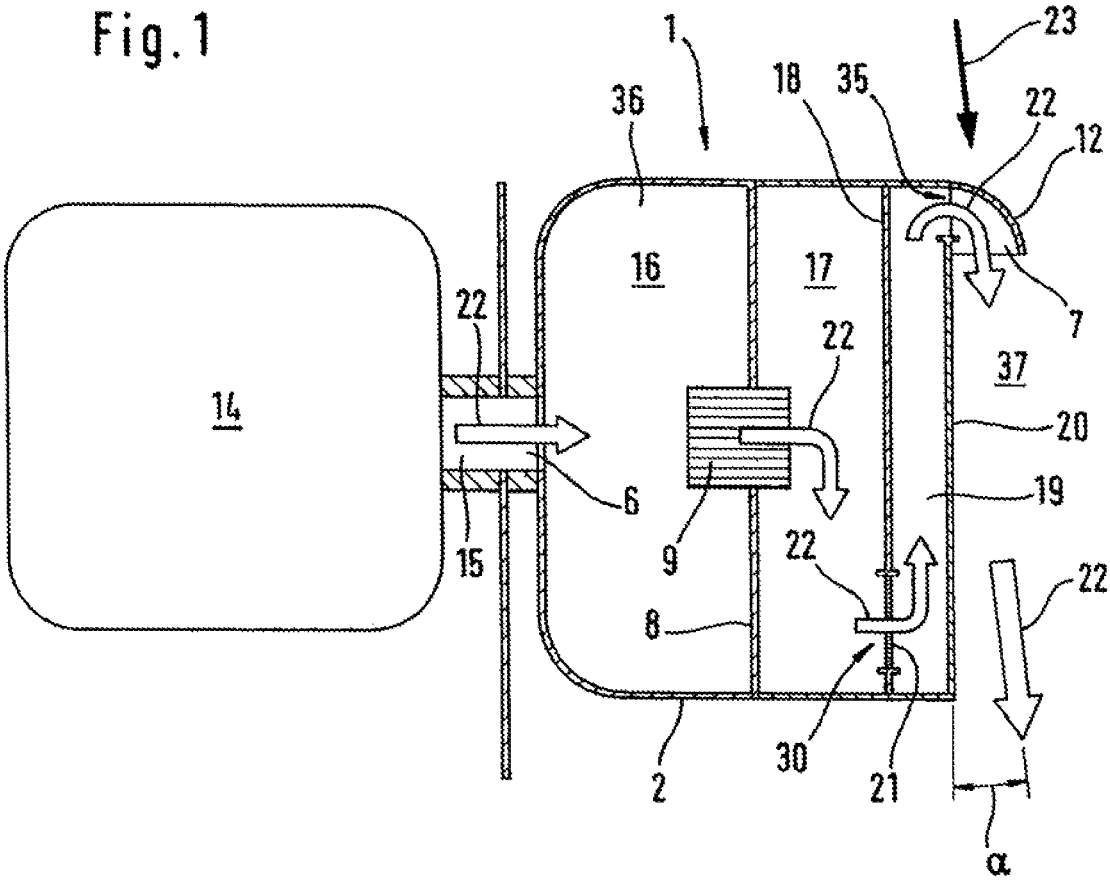
FIG. 1 is an illustration of one exemplary embodiment of an inventive exhaust gas muffler.

The exhaust gas muffler of the present application comprises a housing having an inlet for receiving the exhaust gas from the internal combustion engine, an outlet out of the housing, and an outer wall, wherein the outlet and the outer wall are configured such that exhaust gas flows out of the outlet and over the outer wall, and wherein the exhaust gas that flows out of the outlet draws in atmospheric air between the exhaust gas and the outer wall of the housing.

For the cooling of gas turbines, it is known to use cooling air streams that flow into the hot surrounding air through openings in the surface that is to be cooled. With this type of cooling, an undesired effect can be that hot surrounding air is drawn in between the surface that is to be cooled and the cooling air streams, so that undesirably high temperatures result at the surface that is to be cooled. This effect is described, for example, in "DISCRETE-JET FILM COOLING: A COMPARISON OF COMPUTATIONAL RESULTS WITH EXPERIMENTS", published by the ASME, or in "A Detailed Analysis Of Film-Cooling Physics: Part 1—Streamwise Injection With Cylindrical Holes".

It is now proposed pursuant to the present invention to utilize the undesired effect known with the cooling of gas turbines for the cooling of mufflers. In this connection, the hot exhaust gases are used in order to draw in cool surrounding or atmospheric air against the wall of the muffler. This can be achieved by appropriate design of the discharge angle of the exhaust gases out of the muffler, as well as the flow velocity of the exhaust gas.

By drawing in atmospheric air along the housing wall, the housing wall of the exhaust gas muffler can be actively cooled. To achieve this effect, it is merely necessary to appropriately dimension the discharge angle and the flow velocity of the exhaust gas. Further structural measures are not necessary. In particular, channels or protective hoods on the outside of the housing of the muffler for guiding the exhaust gas along the outside of the housing can be eliminated. An active conveyance of the atmospheric air is also not necessary, since the atmospheric air is drawn in by the underpressure that results between the housing wall and the exhaust gases.

The exhaust gases in the interior of the housing advantageously flows along the outer wall of the housing. In so doing, the exhaust gases heat the outer wall of the housing and are themselves cooled by the heat transfer. The outer wall of the housing is actively cooled by the atmospheric air that is drawn in by the exiting stream of exhaust gas, so that the outer wall of the housing forms a heat exchanger. To achieve a high heat transfer to the atmospheric air, it is provided in particular that the exhaust gases in the interior of the housing, and the atmospheric air on the outside of the housing, flow along the outer wall of the housing in counter current relative to one another, so that a counter current heat exchanger is formed on the outer wall of the housing. Due to the transfer of heat from the exhaust gases to the housing wall, the discharge temperature of the exhaust gas out of the exhaust gas muffler is also considerably reduced. Advantageously formed in the interior of the housing is a channel that is delimited toward the outside of the housing by the outer wall of the housing, and through which flow the exhaust gases. The heat exchanger can be designed via the dimensions of the channel, and the flow velocity in the channel can be adapted to the flow velocity along the outside of the housing such that an optimum heat transfer results. The channel advantageously opens out at the outlet. To guide the exhaust gases over the outer wall of the housing, it is provided that the muffler have at least one hood on which the outlet is formed. The hood can have a straightforward construction, and makes it possible in a straightforward manner to fix the discharge angle of the exhaust gas. In particular, the exhaust gases flow out at the outlet at an angle relative to the outer wall of the housing. In this way, it is possible in a straightforward manner to ensure a drawing-in of atmospheric air between exhaust gases and the outer wall of the housing.

A ramp is advantageously disposed on the outer wall of the housing on that side that is opposite from the outlet. The ramp deflects the exhaust gases and the drawn-in atmospheric air, so that the exhaust gases are mixed with the atmospheric air, and in so doing a further cooling of the exhaust gases is effected. At the same time, by means of the ramp it is possible in a straightforward manner to achieve a prescribed discharge direction. Expediently disposed on the outer wall of the housing is a fin that extends parallel to the direction of flow of the exhaust gases along the outer wall of the housing. The fin forms a delimitation for the drawn-in atmospheric air, thus ensuring that the atmospheric air is passed by along the outer wall of the housing. At the same time, the surface of the exhaust gas muffler is increased via the fin. The exhaust gases flowing in the interior of the fin are also cooled by the drawn-in atmospheric air.

The exhaust gas muffler expediently has two chambers that are successively arranged in the direction of flow of the exhaust gases, whereby a catalytic converter is disposed between the two chambers. The catalytic converter effects an afterburning of the exhaust gases, so that prescribed exhaust gas emission values can be maintained, and the exhaust gas quality can be improved. A spark arrestor screen is expediently disposed in the flow path between the second chamber and the channel. The spark arrestor screen prevents glowing particles, which can be formed in the catalytic converter due to the high temperatures, from reaching the outside of the housing. By disposing the spark arrestor screen in the flow path directly after the catalytic converter, the temperatures at the spark arrestor screen are sufficiently high to burn any particles that might have been retained. A third chamber is advantageously disposed in the flow path between the second chamber and the outlet. In this connection, it is in particular provided that a portion of the exhaust gases flow through the third chamber, and a portion of the exhaust gases flow through the channel. Since not all of the exhaust gases flow through the channel, the flow velocity at the channel can be easily adapted to the flow velocity of the drawn-in atmospheric air, so that a good thermal discharge or removal is established at the heat exchanger. At the same time, the exhaust gases flowing into the third chamber are further cooled.

The muffler is advantageously constructed of two half shells, whereby the half shell that faces away from the internal combustion engine is designated the upper half, and the half shell that faces the internal combustion engine is designated the lower half. The outlet is expediently formed in the upper half, and the inlet is expediently formed in the lower half. In this connection, the outer wall of the housing is in particular a wall of the upper half of the muffler. A straightforward construction results if a first partition is disposed between the two half shells, with this partition separating the first chamber from the second chamber. In this connection, the catalytic converter is in particular disposed in the first partition. It is provided that the exhaust gas muffler have a second partition that is disposed between the first partition and the upper half. The third chamber is, in this connection, advantageously delimited by the second partition and the upper half. A setting of the quantity of exhaust gas flowing through the third chamber can be achieved in a straightforward manner by forming a gap between the second partition and the upper half through which the exhaust gases flow into the third chamber. By means of the flow cross-section of the gap, the quantity of exhaust gas flowing into the third chamber is determined. By means of the quantity of exhaust gas, the temperature of the upper half in the region of the third chamber can be established. The channel is advantageously delimited by the second partition and the upper half. Thus, no further components are required to form the channel. The spark arrestor screen is in particular disposed in the second partition.

Further specific features of the present application will be described in detail subsequently.

DESCRIPTION OF SPECIFIC EMBODIMENTS

Referring now to the drawings in detail, the schematic illustration of FIG. 1 shows an exhaust gas muffler 1 that is disposed on the cylinder 14 of an internal combustion engine. The cylinder 14 is, in particular, the two-cycle or four-cycle engine of a manually-guided implement such as a power saw, a cut-off machine, or the like. The exhaust gas muffler 1 has a housing 2 that is provided with an inlet 6 into the interior 36 of the housing, and an outlet 7 that leads from the housing interior 36 to the outside 37 of the housing. The inlet 6 into the exhaust gas muffler 1 is in communication with the outlet 15 of the cylinder 14, via which outlet the exhaust gases of the internal combustion engine flow out of the cylinder 14. A first chamber 16 and a second chamber 17 are formed in the housing 2 of the exhaust gas muffler 1. The two chambers 16, 17 are separated from one another by a first partition 8. A catalyzer or catalytic converter 9 is disposed in the first partition 8. The exhaust gas muffler 1 has a second partition 18 that is disposed between the second chamber 17 and an outer wall 20 of the housing. The second partition 18 has a window 30 in which is disposed a spark arrestor screen 21. Formed between the second partition 18 and the outer wall 20 of the housing is a channel 19. On that side of the channel 19 that is disposed opposite from the window 30 the outer wall 20 of the housing has an opening 35 that is covered by a hood 12. The outlet 7 out of the exhaust gas muffler 1 is formed on the hood 12.

Figure 2:
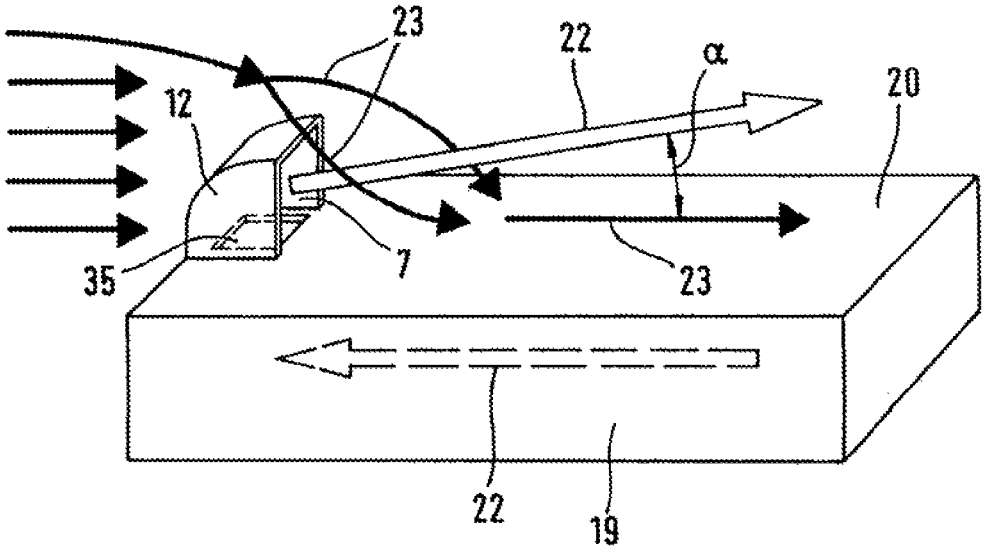
FIG. 2 schematically illustrates the flows along an outer wall of the housing of the exhaust gas muffler.

In operation, the exhaust gases flow in the direction of flow 22 out of the cylinder 14, into the first chamber 16, and through the catalytic converter 9 into the second chamber 17. The exhaust gases leave the second chamber 17 via the spark arrestor screen 21 and enter the channel 19. In the channel 19, the exhaust gases are guided along the outer wall 20 and essentially parallel thereto. The exhaust gases leave the exhaust gas muffler 1 at the hood 12 through the outlet 7. The hood 12 is disposed such that the exhaust gases out of the outlet 7 flow over the outer wall 20 of the housing. The direction of flow 22 of the exhaust gases flowing out of the outlet 7 is inclined at an angle $\alpha$ relative to the outer wall 20 of the housing 2. The direction of flow 22 of the exhaust gases along the outer wall 20 of the housing is such that atmospheric air is drawn in along the outer wall 20 of the housing in the direction of flow 23 between the outer wall 20 and the exhaust gases. The angle $\alpha$ is advantageously approximately 2° to approximately 10°. In particular, the angle $\alpha$ is about 4° to about 8°. An angle $\alpha$ of about 5° to about 7° is particularly advantageous FIG. 2 schematically shows the flow relationships along the outer wall 20 of the housing 2. In the channel 19, the exhaust gases flow along in the direction of flow 22 from the spark arrestor screen 21 to the opening 35, in other words, from right to left in FIG. 2. By means of the hood 12, the exhaust gases are deflected by something less than 180°, so that the exhaust gases leaving the outlet 7 flow along in the direction of flow 22 at an angle α relative to the outer wall 20 of the housing. Due to the inclination of the direction of flow 22 relative to the outer wall 20 of the housing 2, an under-pressure results between the exhaust gases and the outer wall 20, as a consequence of which atmospheric air is drawn in, in the direction of flow 23, between exhaust gases and the outer wall 20 of the housing. In this way a layer of atmospheric air is established flowing between the outer wall 20 and the exhaust gases. In this connection, the atmospheric air, just like the exhaust gases, flows in a direction counter to the direction of flow of the exhaust gases in the channel 19. The exhaust gases in the channel 19 heat up the outer wall 20 of the housing and are thereby cooled off. On the outside 37 of the housing 2, the outer wall 20 of the housing is cooled by the drawn-in atmospheric air. The outer wall 20 of the housing 2 thus forms a heat exchanger.

FIGS. 3 and 4 schematically show the flow of the exhaust gases. As shown in FIG. 3, the exhaust gases that enter inside the muffler into the channel 19 through the window 30 flow in the direction of flow 22 to two hoods 12 disposed on the opposite side of the housing. A portion of the exhaust gas that enters through the window 30 is branched off and flows through a gap, which is formed between the partition 18 and the upper shell or half 3 of the housing 2, into a third chamber 29 of the exhaust gas muffler 1. The exhaust gas flows in the direction of flow 39 in the third chamber 29 and to the hoods 12. In this connection, the flow path in the third chamber 29 is longer, and the flow cross-section in the third chamber 29 is greater, than in the channel 19. The third chamber 29 is disposed adjacent to the channel 19, whereby the channel 19 and the third chamber 29 each respectively extend over about half of the surface of the exhaust gas muffler 1. As shown in FIG. 4, the exhaust gases 22 at the outside of the housing at the outer wall 20 thereof flow from the outlet 7 over the outer wall 20. On the side 38 disposed opposite from the outlet 7 there is disposed a ramp 10, which deflects the exhaust gases. The direction of flow 23 of the atmospheric air extends along the outer wall 20 of the housing approximately parallel to the direction of flow 22 of the exhaust gases, whereby the atmospheric air is drawn in between the outer wall 20 of the housing 2 and the exhaust gases.

Figure 5:
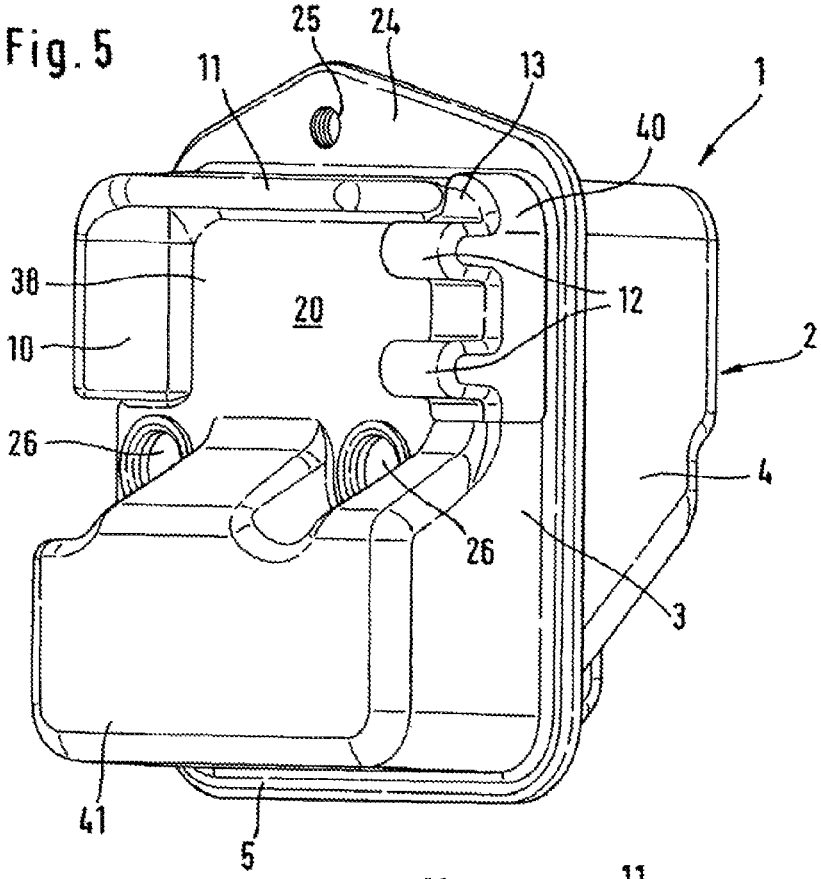
FIGS. 5 & 6 are perspective views of an exhaust gas muffler.
Figure 6:
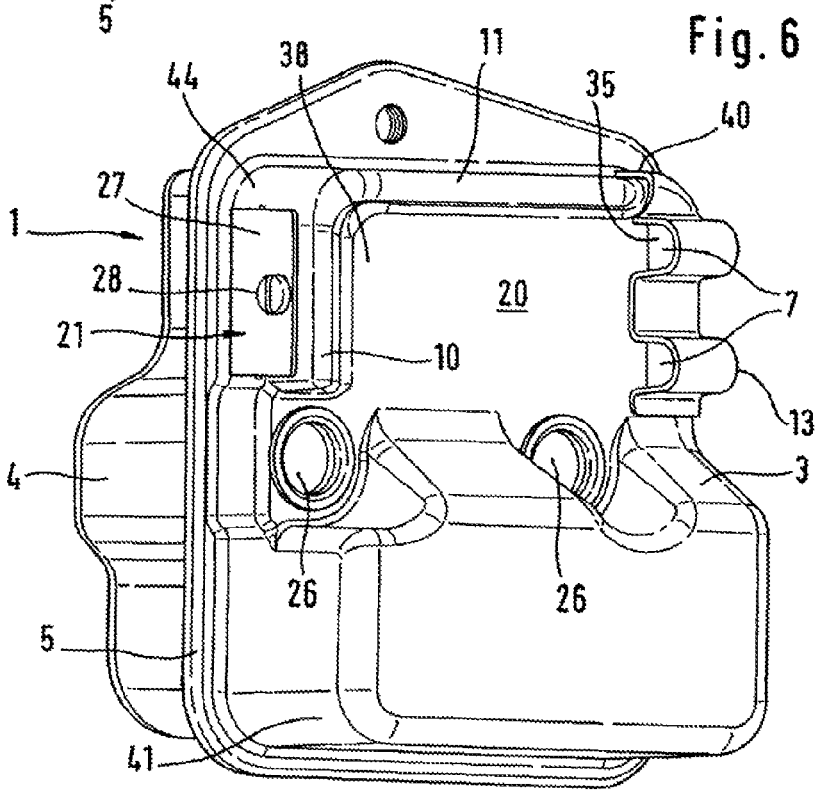

FIGS. 5 and 6 are perspective views of an exhaust gas muffler 1. The housing 2 of the exhaust gas muffler 1 is formed from an upper shell or half 3 and a lower shell or half 4, which are interconnected along an edge 5. At the edge 5, the upper half 3 is flanged about the edge of the lower half 4. The lower half 4 has an inlet 6 and is the half shell that faces an internal combustion engine. For a mounting or fixation on the internal combustion engine, the housing 2 is provided with two through sockets or sleeves 26 via which the exhaust gas muffler 1 can be securely bolted to the internal combustion engine. The edge 5 has a widened portion 24 that is provided with a bore 25. The exhaust gas muffler 1 can also be fixed in position on the internal combustion engine at the bore 25. By securing the muffler at three securement points, a reliable, stable fixation or mounting results. The outer wall 20 of the housing 2 is one wall of the upper half 3. The outer wall 20 of the housing extends on one side of the plane defined by the two sockets 26. On the other side of the plane defined by the two sockets 26, the upper half 3 is provided with a raised portion 41. Disposed on that side of the outer wall 20 of the housing that is disposed opposite the raised portion 41 is a fin or raised element 11 that extends over the entire width b of the exhaust gas muffler 1 (see FIG. 9) and furthermore extends along the outer wall 20 of the housing parallel to the direction of flow 22 of the exhaust gases. The outer wall 20 of the housing 2 is thus delimited parallel to the direction of flow 22 by the fin 11 and the raised portion 41 (see also FIG. 10). As shown in particular in FIG. 6, the outer wall 20 of the housing 2 has an opening 35 that is covered by a cover 13. As shown in FIG. 5, formed on the cover 13 are two hoods 12 that extend in a roof-like manner over the opening 35. The cover 13 has a rim 40 that rests against the upper half 3 and along with the cover 13 is fixed to the upper half 3. The two hoods 12 form the outlet 7. The ramp 10 is disposed on the side 38 opposite the outlet 7. The ramp 10 merges into the fin 11, so that an approximately L-shaped limitation or boundary of the outer wall 20 of the housing results. As shown in FIG. 6, the spark arrestor screen 21 is disposed on that side 44 of the ramp 10 that faces away from the outer wall 20 of the housing. In this connection, the spark arrestor screen 21 is inserted into the non-illustrated second partition 18, and the angled-off edge 27 is fixed on the upper half 3 on the outside of the housing via a screw or bolt 28.

Figure 7:
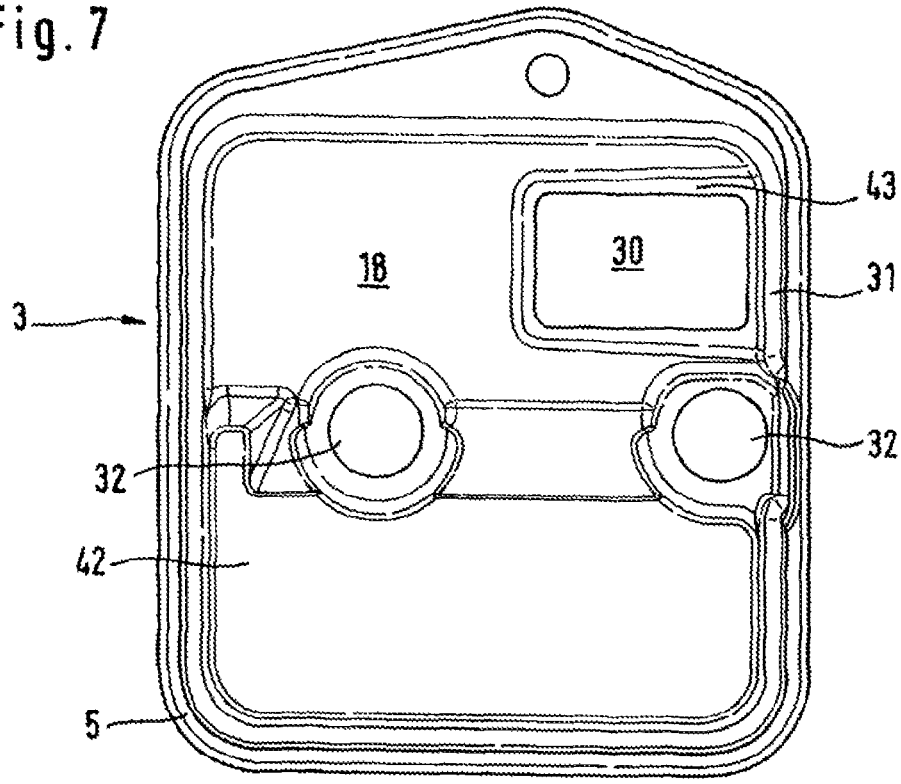
FIG. 7 is a plan view upon the upper half of an exhaust gas muffler having a partition.
Figure 8:
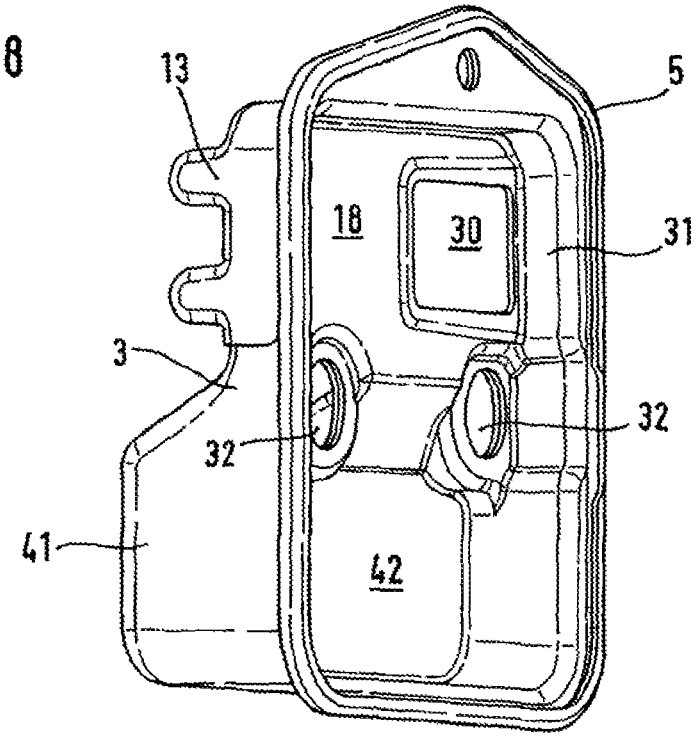
FIG. 8 is a perspective illustration of the upper half of FIG. 7.

As shown in the side view of FIG. 7 of the upper half 3, from the inside of the housing 2, the partition 18 has an edge 43 that extends in a U-shaped manner about the window 30. The side of the window 30 that extends along the side wall 31 of the upper half 3, and parallel to the side wall 31, has no edge. The spark arrestor screen 21 can be inserted into the edge 43 from the side wall 31. The upper half 3 and the second partition 18 have two openings 32 through which the sockets 26 extend. As shown in particular in FIG. 8, on that side that is opposite from the window 30 of the plane formed by the two openings 32, the second partition 18 is provided with a raised portion 42. Thus, the raised portion 42 is disposed in the region of the raised portion 41, whereby an intermediate space or chamber is formed between the two raised portions 41 and 42.

Figure 9:
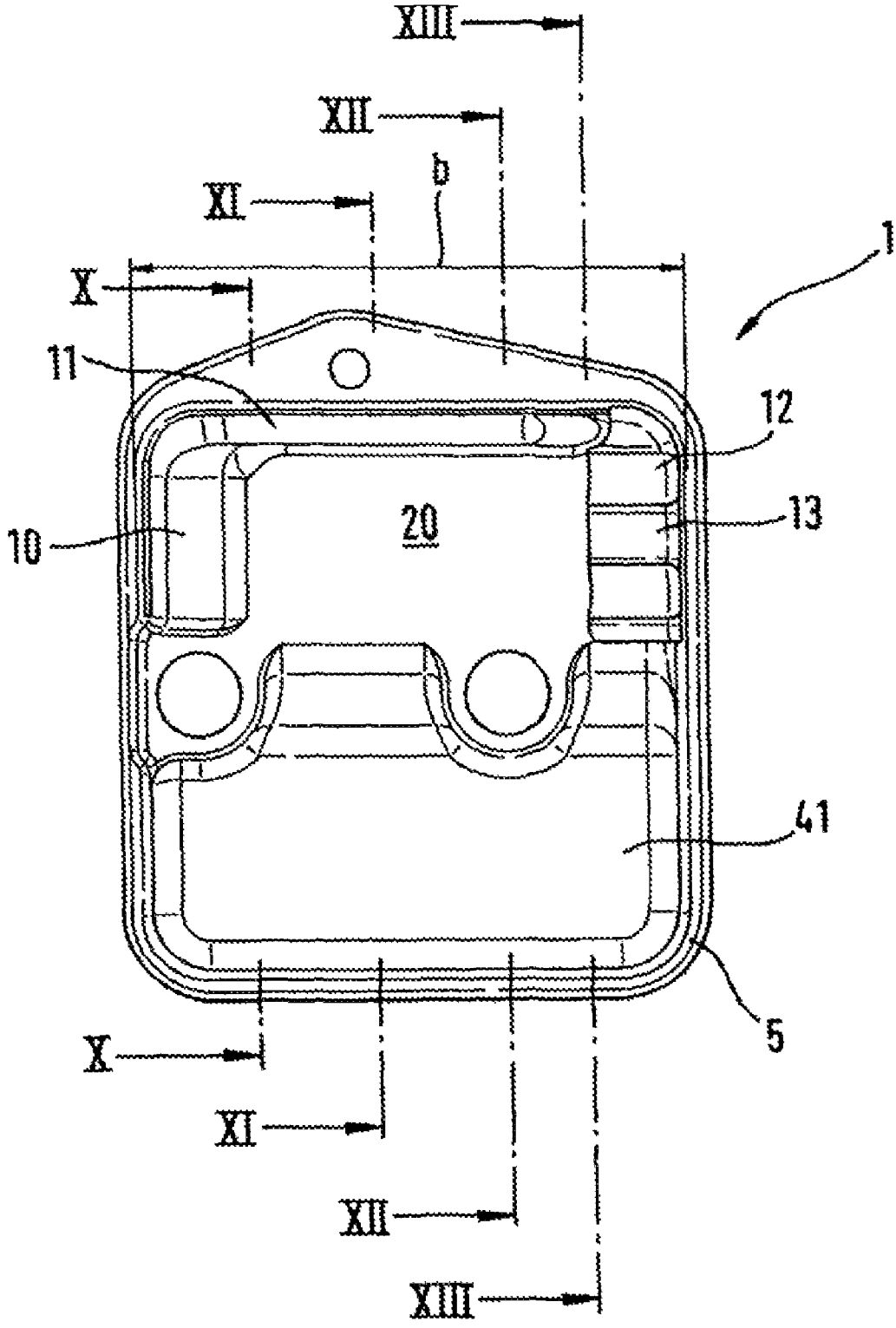
FIG. 9 is a plan view upon the upper half of an exhaust gas muffler.

As shown in FIG. 9, the outer wall 20 of the housing 2 extends over the greatest portion of the width b of the housing 2 of the exhaust gas muffler 1, so that the exhaust gases flow along the outer wall 20 of the housing on the outside 37 thereof over the greatest portion of the width b of the exhaust gas muffler 1. In this connection, the width b is the smaller dimension of the essentially rectangular side of the housing that faces away from the internal combustion engine. The edge 5 extends over the width b.

Figure 10:
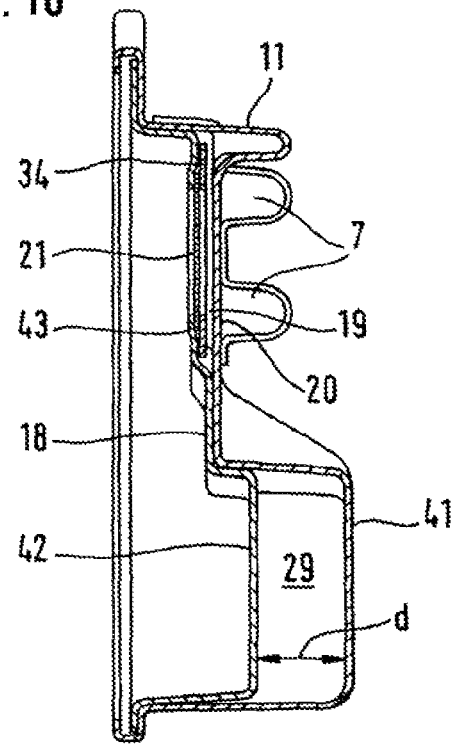
FIG. 10 is a cross-sectional view taken along the line X-X in FIG. 9.

FIG. 10 is a cross-sectional view through the spark arrestor screen 21. The spark arrestor screen 21 is disposed in the edge 43 of the second partition 18. Disposed on the side of the spark arrestor screen 21 that is opposite from the second partition 18 is a holder or retainer 34 that fixes the spark arrestor screen 21 on the second partition 18. Due to the small width a (see FIG. 12) of the channel 19, the outer wall 20 of the housing is effectively heated up by the exhaust gases that flow in the channel 19. The outer wall 20 of the housing 2 is cooled by the atmospheric air that is drawn in on the outside 37 of the housing at the outer wall 20 of the housing, so that a heat exchanger is formed at the outer wall 20 that leads to an effective cooling of the exhaust gases. The flow velocity in the channel 19 is adapted to the flow velocity on the outside of the housing, so that a good transfer of heat results. The adaptation or coordination is effected, in particular, via the flow cross-section in the channel 19, in other words, for example via the width a.

Figure 11:
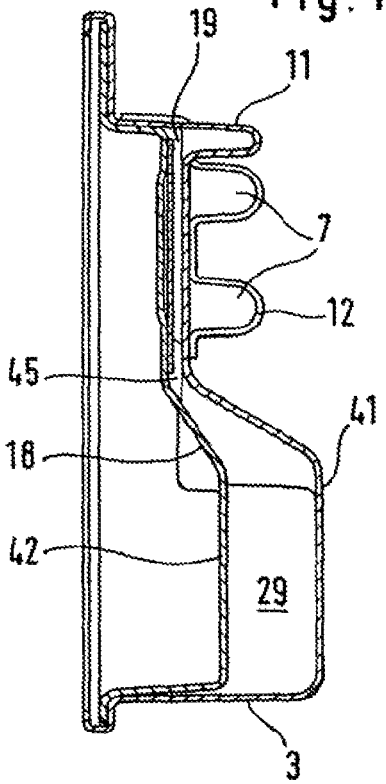
FIG. 11 is a cross-sectional view taken along the line XI-XI in FIG. 9.
Figure 12:
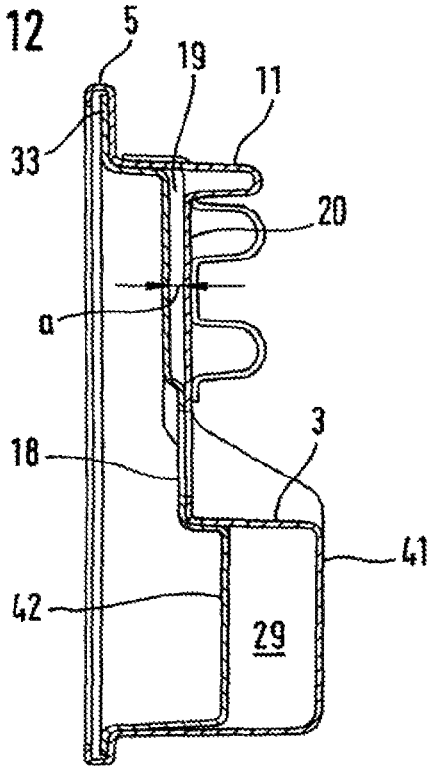
FIG. 12 is a cross-sectional view taken along the line XII-XII in FIG. 9.

A third chamber 29 is formed between the raised portions 41 and 42. As shown in FIG. 12, the channel 19 has a width that is measured perpendicular to the surface of the outer wall 20 of the housing 2, with this width a being considerably less than the distance or spacing d between the raised portions 41 and 42 in a plane perpendicular to the outer wall 20 of the housing. As shown in FIG. 11, the third chamber 29 is connected with the channel 19 via an inlet opening, which in the illustrated embodiment is a gap 45 in the region of the spark arrestor screen 21; a portion of the exhaust gases flowing into the channel 19 flows into the third chamber 29 via the gap 45. By means of the flow cross-section of the gap 45, via which the exhaust gases flow into the third chamber 29, the ratio of the exhaust gases flowing through the section of the channel 19 that extends between the inlet opening and the outlet opening, and through the third chamber 29, can be established. The exhaust gases that flow into the chamber 29 thereby partially bypass the channel 19, and only again enter the channel 19 at the end thereof via the aforementioned outlet opening. Hence, in the section between the inlet opening and the outlet opening the exhaust gases flow either through the channel 19 or through the chamber 29. The channel 19 and the chamber 29 are configured separately and distinct from one another with the exception of the inlet opening and the outlet opening. The fin 11 that delimits the outer wall 20 of the housing has a hollow configuration and delimits the channel 19, so that the channel 19 has an L-shaped flow cross-section. The edge 33 of the second partition 18 is held on the upper half 3, whereby the upper half 3 is flanged about the edge 33 of the second partition 18 at the edge 5. Also held in the flanged-about edge are the first partition 8 and the lower half 4.

Figure 13:
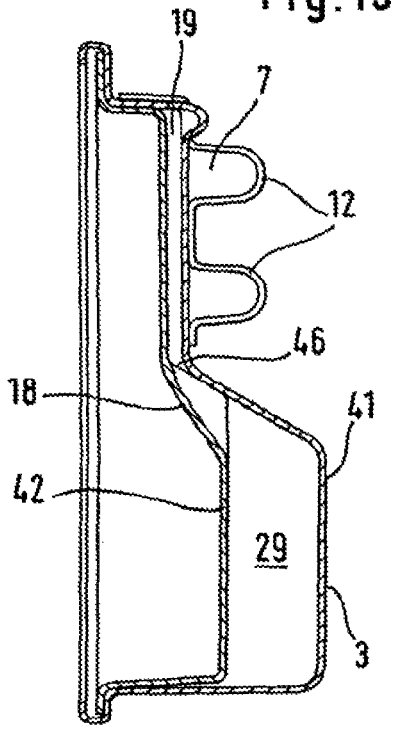
FIG. 13 is a cross-sectional view taken along the line XII-XII in FIG. 9.

As shown in FIG. 13, formed between the upper half 3 and the second partition 18, at the level of the hoods 12, is an outlet opening, which in the illustrated embodiment is a further gap 46 via which the exhaust gases flow out of the third chamber 29 into the channel 19, and from there through the hoods 12 to the outlets 7. By altering the flow cross-section of the gap 46, the proportion of exhaust gases flowing through the third chamber 29 can also be established.

By means of the exhaust gas flowing out of the housing at the angle $\alpha$, the atmospheric air is drawn in against the outer wall 20 of the housing 2, with this outer wall 20 delimiting the channel 19. At the region of the outer wall of the housing that delimits the chamber 29, no atmospheric air is drawn in, so that here no active cooling, and no heat exchange effect, result between the air flowing within the muffler through the chamber 29, and the surroundings. By establishing the proportion of the exhaust gases that flow through the chamber 29, and hence at most partially along the actively cooled outer wall 20 of the housing, the exhaust gas temperature can be established.

The specification incorporates by reference the disclosure of German priority document 103 35 864.1 filed Aug. 6, 2003.

The present invention is, of course, in no way restricted to the specific disclosure of the specification and drawings, but also encompasses any modifications within the scope of the appended claims.

We claim:

1. An exhaust gas muffler for an internal combustion engine, comprising:

a housing having an inlet adapted to receive exhaust gas from said internal combustion engine, an outlet that leads from the interior of said housing to the outside of the housing, and an outer wall, wherein in the interior of said housing exhaust gas flows along an inner surface of said outer wall in a first direction of flow to said outlet, wherein said outlet and said outer wall are configured such that said exhaust gas is adapted to flow out of said outlet, to the outside of said housing, and is deflected such that it flows over said outer wall approximately in a counter direction to said first direction of flow, wherein said exhaust gas flows out of said outlet at an angle of about 2° to about 10° relative to said outer wall of said housing, wherein said angle and a flow velocity of said exhaust gas are such that due to an underpressure resulting from said angle of the direction of flow of said exhaust gas flowing out of said outlet relative to said outer wall of said housing, atmospheric air is adapted to be drawn in between said exhaust gas and an outer surface of said outer wall of said housing to thereby effect an active cooling of said outer wall of said housing via said drawn-in atmospheric air, wherein two chambers are provided in said housing and are successively arranged in a direction of flow of said exhaust gas, wherein a catalytic converter is disposed between said two chambers, and wherein a spark arrestor screen is disposed, relative to a flow path of exhaust gas, between a second one of said chambers and a channel formed in an interior of said housing.

2. An exhaust gas muffler according to claim 1, wherein said exhaust gas flows out of said outlet at an angle of about 4° to about 8° relative to said outer wall of said housing.

3. An exhaust gas muffler according to claim 1, wherein in an interior of said housing, exhaust gas flows along said outer wall of said housing.

4. An exhaust gas muffler according to claim 3, wherein exhaust gas in said interior of said housing, and said atmospheric air on an outside of said housing, flow along said outer wall of said housing in a counter current direction relative to one another to form a counter current heat exchanger on said outer wall, wherein said exhaust gas in said interior of said housing is adapted to heat up said outer wall of said housing and to thereby be cooled, and wherein said outer wall of said housing is adapted to be actively cooled by said atmospheric air that is drawn in, between said exhaust gas and the outer surface of said outer wall of said housing, by said exhaust gas that flows out of said outlet.

5. An exhaust gas muffler according to claim 3, wherein a channel is formed in said interior of said housing, wherein said channel is delimited relative to an outside of said housing by said outer wall of said housing, wherein said exhaust gas flows through said channel, and wherein said channel opens out at said outlet.

6. An exhaust gas muffler according to claim 1, which further comprises at least one hood, wherein said outlet is formed on said at least one hood.

7. An exhaust gas muffler according to claim 1, wherein a ramp is disposed on said outer wall of said housing on a side that is disposed opposite said outlet.

8. An exhaust gas muffler according to claim 1, wherein a fin is disposed on said outer wall of said housing, and wherein said fin extends parallel to a direction of flow of exhaust gas along said outer wall of said housing.

9. An exhaust gas muffler according to claim 1, wherein a third chamber is disposed, relative to a flow path of exhaust gas, between a second one of said chambers and said outlet.

10. An exhaust gas muffler according to claim 9, wherein a portion of said exhaust gas flows through said third chamber, and a portion of said exhaust gas flows through a channel formed in an interior of said housing.

11. An exhaust gas muffler for an internal combustion engine, comprising:

a housing having an inlet adapted to receive exhaust gas from said internal combustion engine, an outlet that leads from the interior of said housing to the outside of the housing, and an outer wall, wherein in the interior of said housing exhaust gas flows along an inner surface of said outer wall in a first direction of flow to said outlet, wherein said outlet and said outer wall are configured such that said exhaust gas is adapted to flow out of said outlet, to the outside of said housing, and is deflected such that it flows over said outer wall approximately in a counter direction to said first direction of flow, wherein said exhaust gas flows out of said outlet at an angle of about 2° to about 10° relative to said outer wall of said housing, wherein said angle and a flow velocity of said exhaust gas are such that due to an underpressure resulting from said angle of the direction of flow of said exhaust gas flowing out of said outlet relative to said outer wall of said housing, atmospheric air is adapted to be drawn in between said exhaust gas and an outer surface of said outer wall of said housing to thereby effect an active cooling of said outer wall of said housing via said drawn-in atmospheric air, wherein said housing comprises two half shells, wherein one of said half shells that faces away from said internal combustion engine is designated an upper half, and the other half shell that faces said internal combustion engine is designated a lower half, and wherein said outlet is formed in said upper half and said inlet is formed in said lower half.

12. An exhaust gas muffler according to claim 11, wherein said outer wall of said housing is a wall of said upper half.

13. An exhaust gas muffler according to claim 11, wherein a first partition is disposed between said two half shells, wherein said first partition separates a first chamber from a second chamber, and wherein a catalytic converter is disposed in said first partition.

14. An exhaust gas muffler according to claim 13, which further includes a second partition that is disposed between said first partition and said upper half, and wherein a third chamber is provided that is delimited by said second partition and said upper half.

15. An exhaust gas muffler according to claim 14, wherein a gap is formed between said second partition and said upper half, and wherein exhaust gas flows through said gap into said third chamber.

16. An exhaust gas muffler according to claim 14, wherein a channel is provided that is delimited by said second partition and said upper half.

17. An exhaust gas muffler according to claim 14, wherein a spark arrestor screen is disposed in said second partition.

18. An exhaust gas muffler for an internal combustion engine, comprising:

a housing having an inlet for receiving exhaust gas from said internal combustion engine, an outlet that leads from the interior of said housing to the outside of the housing, and an outer wall, wherein a channel is formed in said interior of said housing, wherein said channel is delimited relative to said outside of said housing by said outer wall of said housing, wherein said channel opens out at said outlet, wherein in the interior of said housing exhaust gas flows through said channel along an inner surface of said outer wall in a first direction of flow to said outlet, wherein said outlet and said outer wall are configured such that said exhaust gas is adapted to flow out of said outlet, to the outside of said housing, and is deflected such that it flows over said outer wall approximately in a counter direction to said first direction of flow in said channel, wherein said exhaust gas that flows out of said outlet to the outside of said housing draws in atmospheric air between said exhaust gas and an outer surface of said outer wall of said housing, wherein said housing includes a chamber, "wherein said chamber is separated from said channel by means of a partition and is connected to said channel by an inlet opening and an outlet opening, wherein a first portion of said exhaust gas is adapted to flow through said channel to said outlet, wherein a second portion of said exhaust gas is branched off and is adapted to flow through said chamber from said inlet opening to said outlet opening thereof such that said second portion of said exhaust gas at least partially bypasses said channel, and wherein said first portion of said exhaust gas and said second portion of said exhaust gas are rejoined upstream of said outlet of said housing.

19. An exhaust gas muffler according to claim 18, wherein a path of flow of said exhaust gas in said chamber is longer than a path of flow of said exhaust gas in said channel, and wherein a flow cross-section in said chamber is greater than a flow cross-section in said channel.

* * * * *